United States Patent [19]

Bénard

[11] Patent Number: 4,514,900

[45] Date of Patent: May 7, 1985

[54] APPARATUS TO MANUFACTURE HEAT EXCHANGER FINNED TUBE

[75] Inventor: Jacques A. V. Bénard, Paris, France

[73] Assignee: Con Rad Industries, Inc., Sand Springs, Okla.

[21] Appl. No.: 323,539

[22] Filed: Nov. 20, 1981

[51] Int. Cl.[3] ..... B23P 15/26

[52] U.S. Cl. ..... 29/727; 29/157.3 AH; 29/456; 165/180; 165/182; 165/184

[58] Field of Search ..... 29/157.3 AH, 727, 456; 165/180, 182, 184

[56] References Cited

U.S. PATENT DOCUMENTS

| | | | |
|---|---|---|---|
| 1,992,297 | 2/1935 | Dewald | 165/184 |
| 2,956,335 | 10/1960 | Matheny et al. | 29/157.3 AH |
| 3,112,558 | 12/1963 | Nihlen et al. | 29/157.3 AH |
| 3,500,903 | 3/1970 | McElroy | 29/157.3 AH |
| 4,103,408 | 8/1978 | Joekel | 29/157.3 AH |

*Primary Examiner*—Howard N. Goldberg
*Assistant Examiner*—P. W. Echols
*Attorney, Agent, or Firm*—Bill D. McCarthy

[57] ABSTRACT

The present invention comprises an improved heat exchanger finned tube and method and apparatus for producing elongated segments of the finned tube comprising knurling the outside surface of a central tube of heat conductive material, forming strip stock material into a continuous fin and spirally winding the fin about the outer knurled surface of the central tube. The fin comprises a foot portion to form a substantially L-shaped cross-section, the foot portion being in contact with the central tube and having a heel portion slightly overlapping a toe portion of the next succeeding fin wrap. A second knurling operation over the outer surface of the foot of the fin forces the foot portion to be deformed into the knurling present on the outer surface of the central tube and interlocking with the next succeeding fin wrap. The method and apparatus further comprises a transversely operated saw for cutting the finned tube to a desired length, automatic ejection of a tube pilot guide member and return of the pilot guide member to the operator.

6 Claims, 12 Drawing Figures

APPARATUS TO MANUFACTURE HEAT EXCHANGER FINNED TUBE

BACKGROUND OF THE INVENTION

1. Field of the Invention

The present invention relates to an improved heat exchanger finned tube and method and apparatus for producing said finned tube and more particularly, but not by way of limitation, to a finned tube which comprises spirally wrapped fin stock material around tubing stock with a double knurling operation to provide intimate contact of the fin stock with the tubing material to insure maximum durability and conductivity.

2. History of the Prior Art

There has been considerable effort expended to produce heat exchanger finned tube material for use with various forms of heat exchangers, radiators and the like. The major portion of finned tube material comprises thin metal strips of stock or plate material attached to the outer surface of a tube or pipe in order to effectively increase the surface area of the tube for either expelling heat from or conducting heat to a fluid carried within the tube or pipe.

Fin stock has been attached to the fluid carrying tube by various techniques, including welding, brazing, soldering, gluing and even tightly wrapping the fin stock about the outer surface of the tube.

Three different basic configurations have been utilized in producing fin stock material, one being to weld longitudinal strips of fin stock material about the outer surface of the tube; the second being to place a plurality of washer-like discs of fin material about the tube and welding them in a spaced relation along the tube; and the third being to spirally wrap the fin stock material about the outer surface of the tube.

A considerable portion of the finned tube produced comprises aluminum fin stock which is attachable to various types of central tubes. Aluminum is a widely used fin stock material and has the characteristics of being somewhat malleable and yet heat conductive.

As stated, in some applications the fin stock material is spirally wound tightly about the central tube. However, when such material fails due to thermal shock conditions or other causes of failure, often a significant portion of the fin becomes unwound and cannot be repaired on the site. Another problem associated with presently produced finned tube is that there are often gaps or separation points between the fin stock and the tube thereby interrupting heat conductivity and reducing the effectiveness of the finned tube.

The use of welding techniques to secure the fin stock to the tube helps prevent failure due to separation of the fin stock from the tube but is extremely expensive and, in the use of aluminum fin stock, welding techniques require sensitive MIG or TIG welding equipment.

The use of adhesive to secure the fin stock to the tube serves to more firmly attach the fin stock but often has an insulative effect between the fin stock and the tube, again, reducing the effectiveness of the finned tube as a heat conductor.

Presently used apparatuses for producing spirally wound finned tubing material typically require two or more operators per finning machine in order to handle the finned tube that is produced on the machine. Typically, at least one operator is required to devote his full attention to the finning head area of the machine while another operator must be involved in the handling of the completed finned tubes and sawing the tubes to length. Further, if the central tubing used to form the fin stock is to be cut during the middle of an operation, the entire finning operation must be stopped while the material is cut to the desired length. Therefore, the use of multiple operators for producing fin stock material causes the end product to be expensive, a large portion of which is due to labor costs.

SUMMARY OF THE PRESENT INVENTION

The present invention provides a heat exchanger finned tube material and a method and apparatus for producing same in a substantially continuous process which is particularly designed to overcome the above disadvantages.

In the present process a central pipe or tube may consist of one of several heat conductive materials which is fed into the finning head area by a spaced pair of sets of power driven knurling wheels.

A central pipe or tube which may consist of one of several heat conductive materials is fed into the finning head area by one of said power-driven knurling wheels. The knurling wheels impart both rotational and longitudinal movement to the bare tube while knurling the entire outer surface thereof. The two sets of drive knurling wheels may be operated in succession in order to provide bare spaces on the tube corresponding to what will be the end portions of finished finned tubes.

Once the first end of the tube stock has passed to the finning head, a tube pilot guide member is inserted in the end of the tube to assist the travel of the finned tube down the track or passageway.

Aluminum fin stock is disposed on a horizontal roll beneath the rack upon which the finned tube will be produced and is fed to the finning head area through a series of forming rollers. The first forming roller imparts an approximate 45° bend along one edge of the fin stock to start formation of the foot element of the fin. The second forming roller increases the bend to about 60°.

The remaining surface of the fin, having the partially formed foot along one edge thereof, is then passed through a laminating head or finning head consisting primarily of a helix nut and spinal roller. The helix nut is provided with a central aperture wherein the knurled tube stock passes through. One surface of the helix nut is in the shape of a very shallow frusto-conical section.

The spinal roller is a substantially conical shaped roller which is disposed with respect to the helix nut surface to form a tapered shaped wedge for the fin surface to pass through. The tapered wedge opening formed between the helix nut and spinal roller serves to reduce the thickness of the fin stock, with the thickness of the outer edge thereof being more reduced than that of the inner edge adjacent the foot. This serves to stretch the outside edge of the fin stock more than the inside which causes the strip to curl into a circular helical configuration so that the foot thereof comes into direct contact with the knurled surface of the tube. By adjusting the angle and spacing of the spinal roller against the helical nut, the size of the curl is adjusted to fit various sizes of tube stock.

The force between the helix nut and the spinal roller controls the amount of thinning of the fin strip. The roller force should be adjusted so as not to thin the stock at the base of the fin and provide a uniform taper from the base to the outside edge. The rotation of the spinal roller with respect to the helix nut must be adjusted with the tube rotational and longitudinal speeds to provide a snug fit. This is accomplished by adjusting the speed of the tube with a variable sheath which in turn drives the knurling rollers. Overspeed will cause a cupping action of the fin whereas underspeed will cause a loose fin neither of which results in acceptable finned tube stock.

As the fin is spiraled onto the tube, the foot is bent to a substantial 90° angle with respect to the fin surface. It is noted that the fin is placed on the tube with a close tolerance fit without either stretch wrapping the fin onto the tube or loosely fitting the fin to the tube. Adjacent the spinal roller is an adjustable fin straightening guide which serves to straighten the fin so that it is substantially perpendicular to the surface of the tube.

After the tube has advanced several turns, a second knurling wheel is inserted between adjacent fins and brought into contact with the spiral-wound foot portion of the fin which serves to knurl the foot portion of the fin into the grooves present on the already knurled tube. The knurling wheel is an idler wheel having some longitudinal degree of freedom in addition to being rotationally free. The knurled spacing on the outer surface of the knurling wheel is substantially identical to the knurl spacing for the tube drive knurls so that the knurling wheel will tend to press and deform the foot of the fin down into the already knurled tube surface thereby producing intimate contact between the tube and the fin stock.

It is further noted that the knurling operation, due to the spacing configuration of the fins, causes a slight overlap of the heel portion of each fin to the toe portion of the next succeeding fin to cause the foot portions of the fin to, in essence, grip to each other in an interlocking fashion in addition to gripping the knurled surface of the tube. The thickness of the knurling wheel is slightly greater than the spacing between the fin wraps at the base thereof so that when it is pressed into contact with the foot portion it actually forms a very small protruding heel portion which overlaps the toe portion of the next succeeding wrap. This second knurling wheel also comprises a pair of oppositely disposed spaced alignment plates which further align the fins and hold them in alignment during the second knurling operation.

After a tube has been completed and the end of the fins secured by stapling or the like, a conveyor or tube pushing device is attached to the end of the tube which forces the finned tube down along a tube rack until a positioned micro-switch is made thereby stopping longitudinal movement of the finned tube at a position so that the bare spot or intended end of the tube is adjacent a transverse circular saw. The tube is clamped in this position while it is sawed to an exact predetermined length.

Lift arms then pick up the finished finned tube and allow it to roll back against a first set of stops. Upon reaching the stops, an air blast cylinder is automatically placed into contact with the end of the tube sending a blast of air along the tube which blows the tube pilot guide member out of the end of the tube and onto a second conveyor track which brings the tube pilot back to the operator station. After the tube pilot has been ejected, the supporting rack is lowered thereby allowing the finished tube to roll onto the tube rack.

While the sawing and pilot ejection system is in operation, the operator may begin finning the next succeeding tube so that the entire finning operation may be accomplished by a single operator. The bare tube feed racks and the finished finned tube holding racks may be filled and emptied periodically by other workers or even by the operator while finning is not being accomplished.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1A:
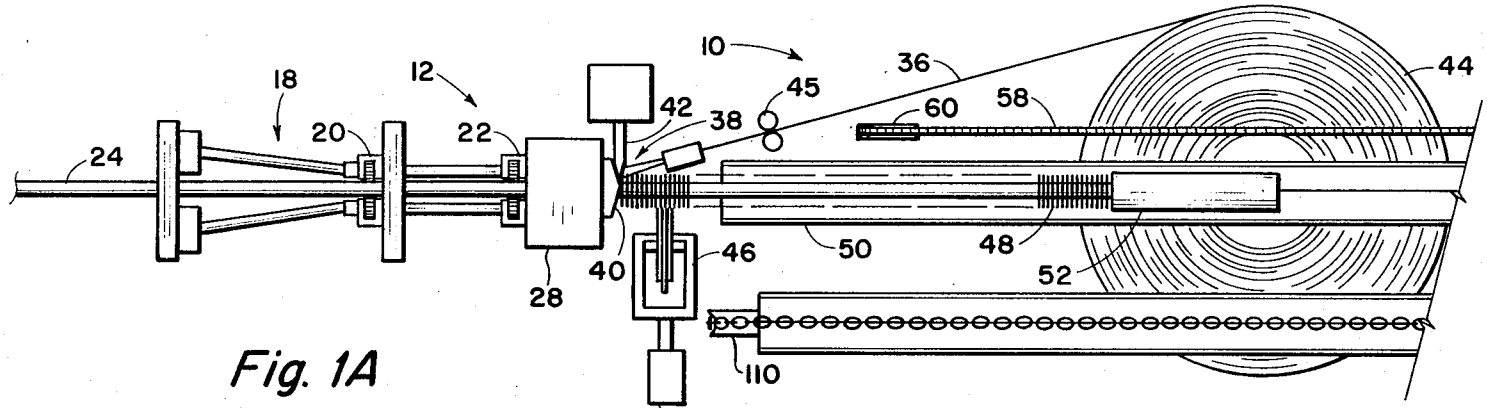
FIGS. 1A and 1B depict a plan view of an apparatus for forming spiral finned tubing embodying the present invention.

Referring to the drawings in detail, reference character 10 generally indicates an apparatus for forming heat exchanger finned tubing by a spiral wrapping, double knurling process that will be hereinafter more fully described. The apparatus generally comprises a knurling drive apparatus 18, a finning head system 12 where the fin stock is applied to the tube material, a tube sawing apparatus generally indicated by reference character 14 and a pilot ejection and finned tube handling mechanism generally indicated by reference character 16.

The tube knurling and drive apparatus 18 comprises a first set of knurling wheels 20 and a second set of knurling wheels 22 which are spaced apart and are operated sequentially. Central tubing material 24 is fed into the tube knurling and drive mechanism 18 whereupon the tubing is gripped by the knurling wheels 22. The knurling wheels 22 impart both rotational and longitudinal movement to the tubing 24 while impressing a plurality of closely spaced substantially longitudinal grooves in the outer surface of said tubing. The grooves will have a slight pitch from the longitudinal relative to the pitch angle of the spiral fins.

Figure 11:
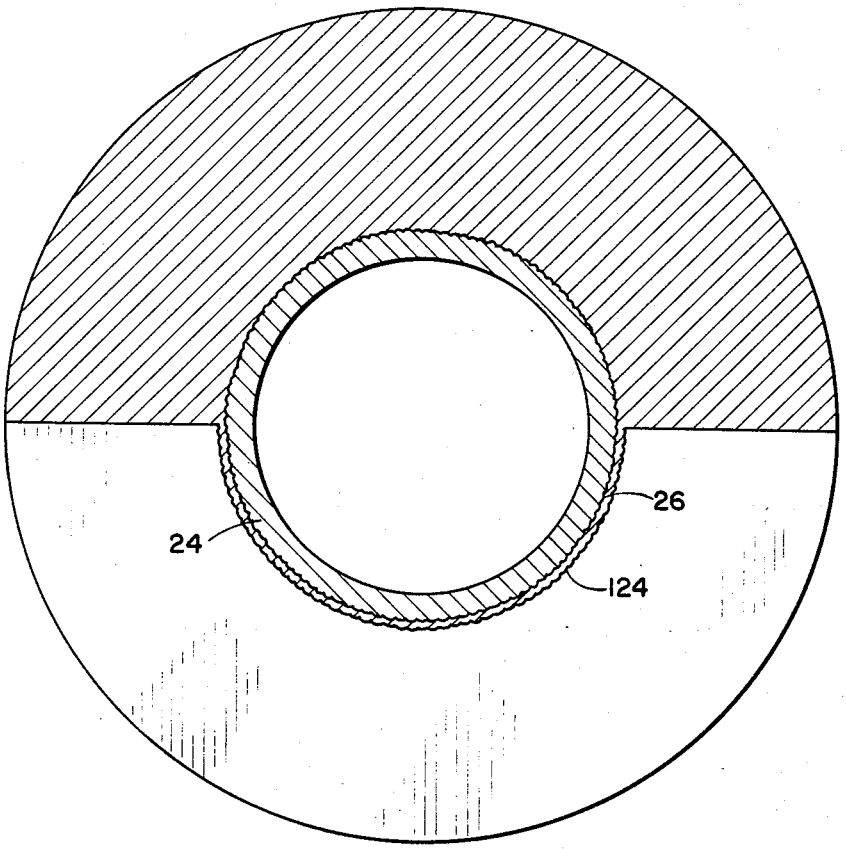
FIG. 11 is an end elevational sectional view of the finned tube of FIG. 10.

These grooves or knurling impressions are indicated by reference character 26 and appear in the end sectional view of FIG. 11 of the drawings. Rotary drive for the knurling wheels is provided by a drive source (not shown) through a plurality of drive wheels or pulleys 28 which comprise a variable sheath and which are connected to the drive source through a plurality of belts 30.

The finning head system 12 further comprises two sets of forming rollers 32 and 34 shown in FIGS. 2 and 3 for acting upon strip fin stock indicated by reference character 36 in a manner that will be hereinafter set forth. The finning head system further comprises a laminating head 38 which is made up of a helix nut 40 which operates in conjunction with a laminating cone referred to as a spinal roller 42 to form a tapered wedge for passing the fin stock material 36 therethrough for producing a curl in the fin stock in a manner that will be hereinafter set forth. The fin stock material 36 may be mounted on a dispensing roll 44 and passed through guide rollers 45 before entering the form rollers 32 and 34.

The finning head further comprises a second knurling roller apparatus 46. The finished finned tube material indicated by reference character 48 is moved along a V-shaped track 50 after exiting the finning head system 12. The end of the finished finned tube is guided along the track 50 by means of a tube pilot guide member 52 which is of substantially the same diameter as the finished finned tube and having a centrally disposed mandrel 54 at one end thereof for inserting within the tube 24. The elongated V-shaped track 50 is naturally in longitudinal alignment with the finning head system 12.

After a given length of finished finned tube is disconnected from the finning head system 12, it is pushed into a sawing position by a tube pushing mechanism 56. The tube pushing mechanism 56 is mounted on an endless chain 58 carried by spaced pulleys 60 and 62 the chain 58 being parallel to the finned tube track 50. The chain and associated pushing mechanism 56 are driven by a power source 63.

The tube drive mechanism comprises a pivotal drive arm 64 having an elongated mandrel 66 attached thereto for inserting into the interior of the central tube 24.

The tube cutting apparatus 14 comprises a pivotally mounted rotary saw 68 and a pair of pivotally mounted clamping arms 70 and 72 which may be activated by a single or double power source generally indicated by reference character 74. The device 74 is activated by a microswitch 76 which, in turn, is contacted by the tube pilot guide member 52. The switch 76 is further connected to the power drive 63 to stop the pusher 56 in order to start the sawing operation. Upon activation, the clamping arms 70 and 72 are closed about the central tube 24 to hold the tube in place while the saw 68 is pivoted against the tube 24 to complete the sawing operation.

Figure 1B:
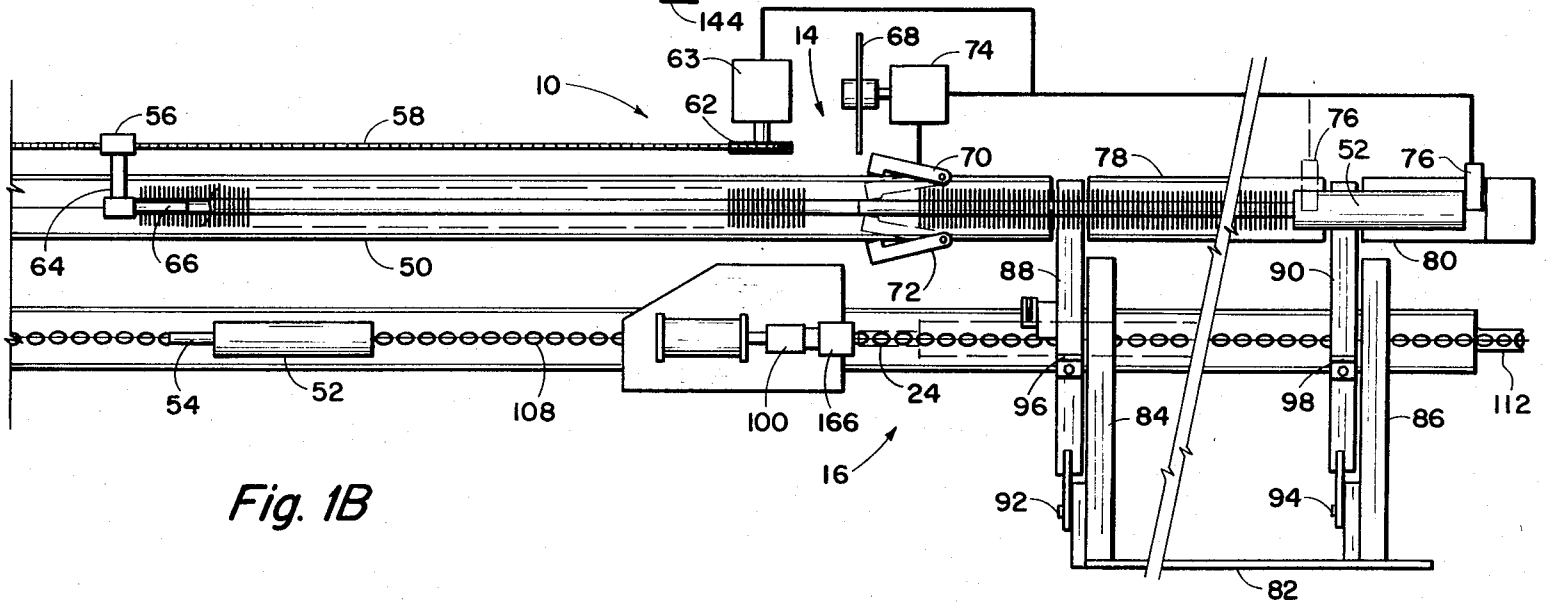

The finned tube track 50 is provided with a plurality of separated aligned segments 78 and 80 shown in FIG. 1B. The tube handling mechanism generally indicated by reference character 16 comprises a tube rack or frame structure 82 having spaced transverse members such as 84 and 86 for supporting the finned tube sections. The members 84 and 86 are inclined from the horizontal as shown in FIGS. 8 and 9 to allow the finished tube to roll away from the tracks 50, 78 and 80 and against a stop member 156.

The tube handling system 16 further comprises a plurality of spaced elongated arm members 88 and 90 which are pivotally mounted to the frame at pivot points 92 and 94, respectively. The outer ends of the arm members 88 and 90 are provided with upwardly extending end portions 95 which are disposed within the gaps between the track segments 50, 78 and 80 for enabling the arms to pick up the finished finned tube after it has been sawed to length. The upper surfaces of the arms 88 and 90 are provided with stop members 96 and 98. It is noted that there may be any number of arm members 88 and 90 according to the length of the tube being produced.

Figure 8:
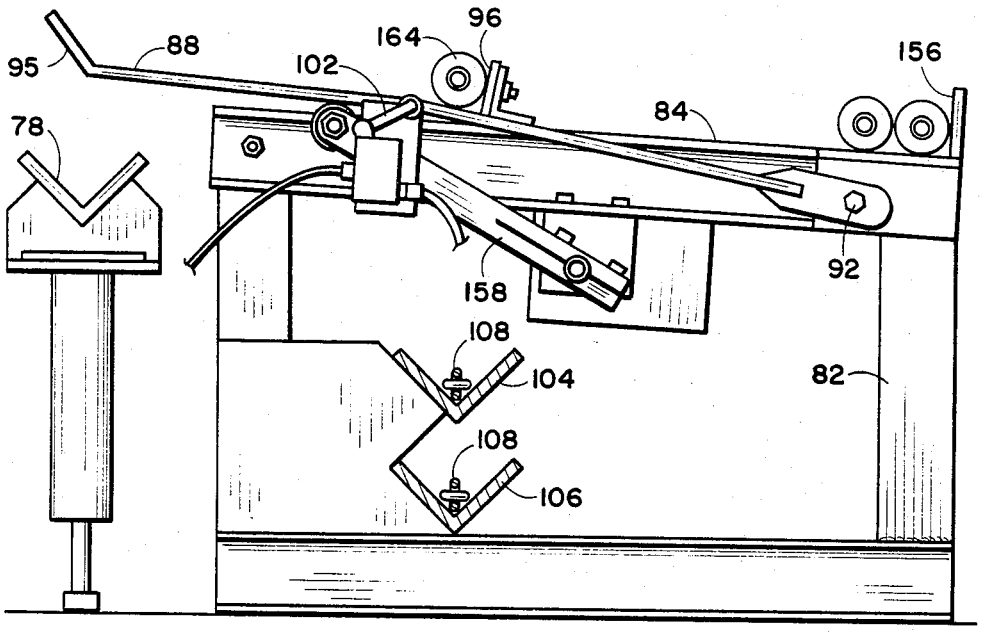
FIG. 8 is an end elevational view of a portion of the finned tube handling device of the machine of FIGS. 1A and 1B in a first position.
Figure 9:
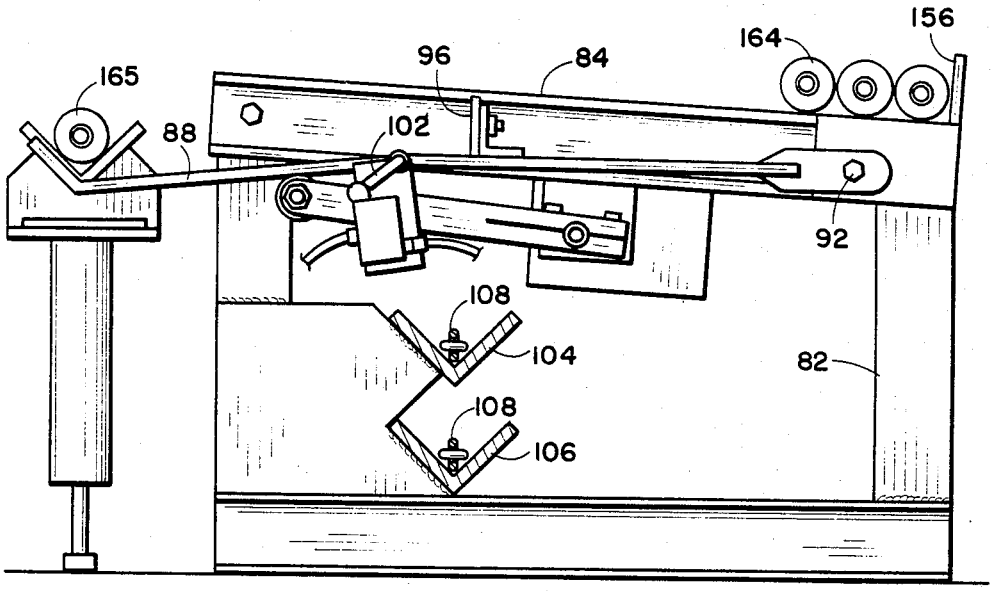
FIG. 9 is an end elevational view of the device of FIG. 8 in a second position.

The arm members 88 and 90 are operated by hydraulic or pneumatic actuated arms 158 in such a manner that when the arm members 88 and 90 are in an upward position as shown in FIG. 8, the stop members 96 and 98 extend above the transverse frame member 84. On the other hand, when the arm members 88 and 90 are in their lowest position as shown in FIG. 9, the stop members 96 and 98 are recessed below the surface of the transverse members 84 and 86 to allow the tube member to roll along the inclined surface of the transverse frame members 84 and 86 toward the stop member 156.

A pneumatic air gun apparatus 100 is positioned in alignment with the stop members 96 and 98 and is activated by a micro-switch 102 carried by the pivotal arm member 88 in a manner that will hereinafter be described.

The finned tube handling apparatus and pilot ejection system 16 further comprises a pair of vertically spaced V-shaped tracks 104 and 106 which are parallel to the track 50 and disposed directly below the stop members 96 and 98 whereby the air gun 100 may, by sending a blast of air down the tube 24, blow the tube pilot guide member 52 out of the end of the finished finned tube so that it will fall into the track 104. The track 104 and 106 carries an endless chain 108 driven by end pulleys 110 and 112 which acts as a conveyor belt to return the tube pilot guide member 52 back to the general location of the finning head system 12 as shown in FIG. 1A.

Figure 2:
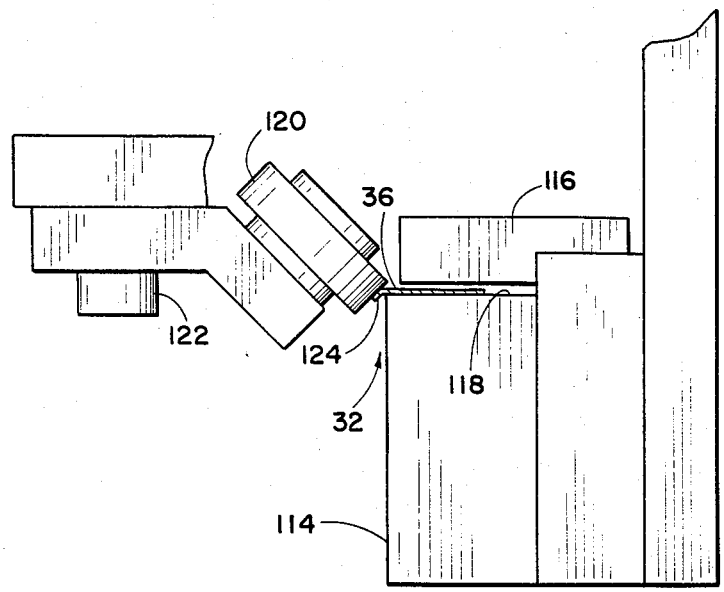
FIG. 2 depicts a first forming roll for forming fin stock into a substantially L-shaped cross-section embodying the invention.
Figure 3:
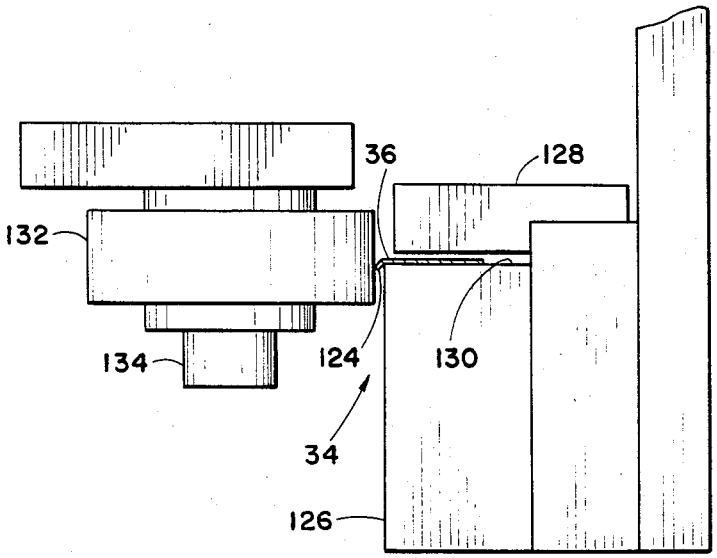
FIG. 3 is a plan view of a second forming roll.

Referring to FIG. 2 of the drawings, the first forming rolls comprise framework 114 and a spaced plate member 116, the gap between the plate 116 and the frame 114 forming a fin strip guide passageway 118. A roller member 120 is rotatably mounted at 122 and set at an angle with respect to the frame 114 for imparting a bend along one edge of the fin strip to begin formation of what will be referred to as a foot member 124 therealong. The foot member 124, after passing through the first forming rolls 32 will be bent to an angle of approximately 45° with respect to the plane of the fin strip.

The second forming rolls 34 comprise a frame member 126 and a spaced plate member 128 for forming a passageway 130 therethrough. The forming rolls 34 comprise a roller 132 rotatably mounted at 134 and being spaced from the frame member 126 to apply a further bend to the foot member 124 to a position of approximately 60° with respect to the fin strip.

Figure 4:
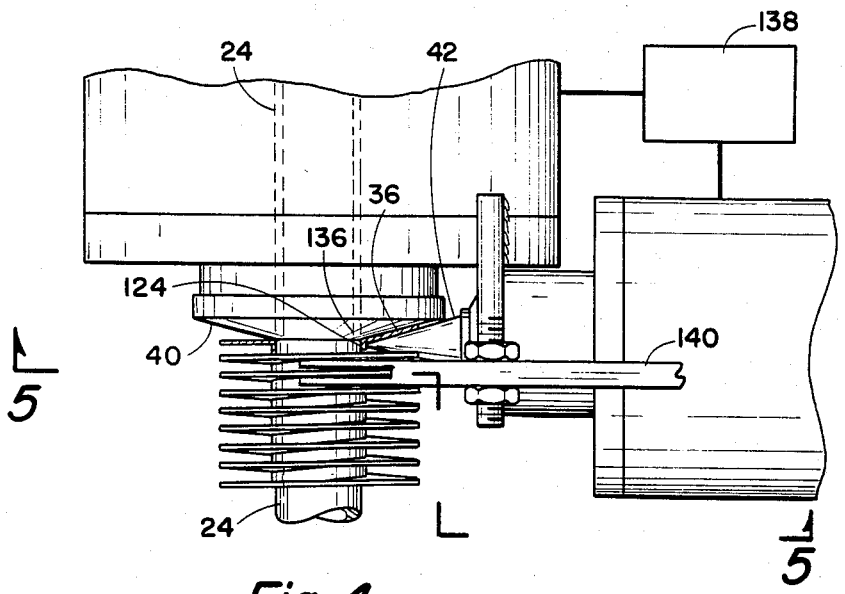
FIG. 4 is a plan view of the finning head portion of the machine of FIGS. 1A and 1B.
Figure 5:
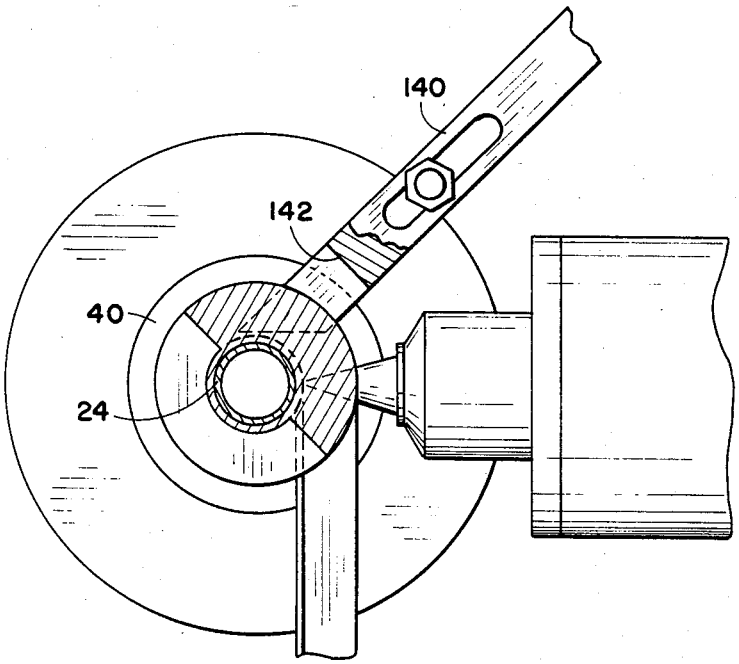
FIG. 5 is an end elevational sectional view of the finning head portion of FIG. 4 taken along the broken lines 5—5 of FIG. 4.

Referring now to FIGS. 4 and 5 of the drawings, the helix nut 40 and spinal roller 42 form a wedge for allowing the fin strip 36 to be passed therebetween. The helix nut 40 is provided with a central aperture 136 for receiving the central tube material 24 therethrough. The rotary motion of the helix nut 40 and the cone member 42 is controlled by a synchronous control drive indicated by reference character 138 which must, in turn, be adjusted with respect to the knurling drive rollers 22 hereinbefore described.

The fin strip material 36 is passed between the spinal conical roller 42 and the helix nut 40 with the foot portion 124 of the fin strip passing by the outer end of the conical spinal roller 42 and into contact with the outer knurled surface of the tube 24. The spacing and angle between the conical spinal roller 42 and the helix nut 40 are such that the outer edge of the fin stock is compressed or swedged to cause the fin stock to curl about the tube into a helix. As the fin stock is wrapped onto the tube, the bending of the foot member 124 to a substantially right angle with respect to the remaining fin material is accomplished between the end of the spinal roller 42 and the tube 24 as shown in FIG. 5. The fin is aligned substantially vertically with respect to the tube 24 by means of an adjustable guide finger 140. The guide finger 140 is provided with an aperture at 142 wherein the outer portion of the fin strip is guided through the aperture 142 to align the fin into a nearly perpendicular relationship with respect to the outer surface of the tube 24.

The second knurling roller mechanism 46 is provided with a hydraulic or pneumatic ram cylinder 144. The cylinder 144 acts on a yoke apparatus 146 which rotatably carries a thin knurling wheel 148. The knurling wheel 148 is journalled within the yoke 146 by a shaft 150 and is positioned between a pair of circular guide plates 152 and 154. The knurling wheel 148 and guide plates 152, 154 are not power driven, but free to rotate. They also have a certain amount of longitudinal freedom along the axis of the shaft 150. The plates 152 and 154 are spaced from the knurling wheel by an amount sufficient to allow two adjacent fin members to ride therebetween when the knurling wheel 148 is placed into pressing contact with the foot portion 124 of the fin stock.

Figure 6:
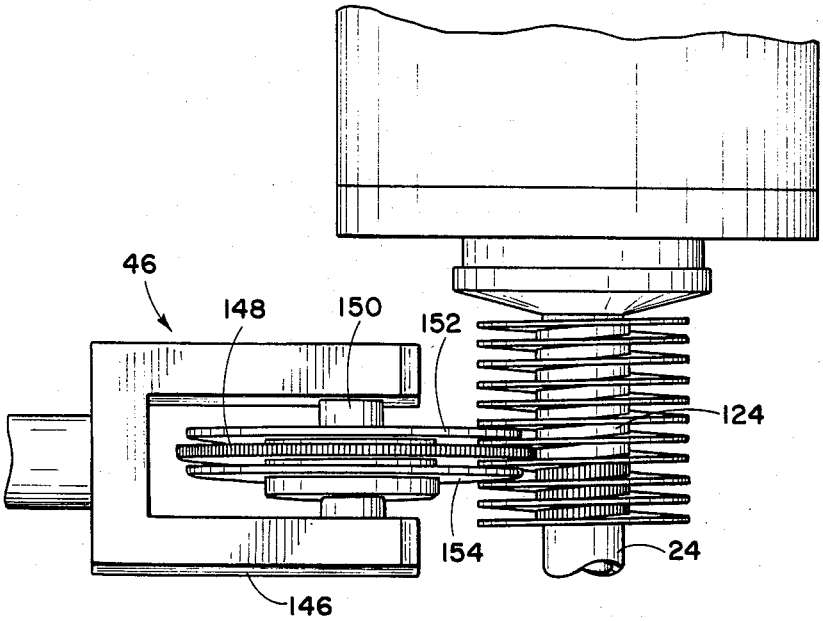
FIG. 6 is a plan view of the finning head portion of the machine depicting a second knurling roller embodying the present invention.
Figure 7:
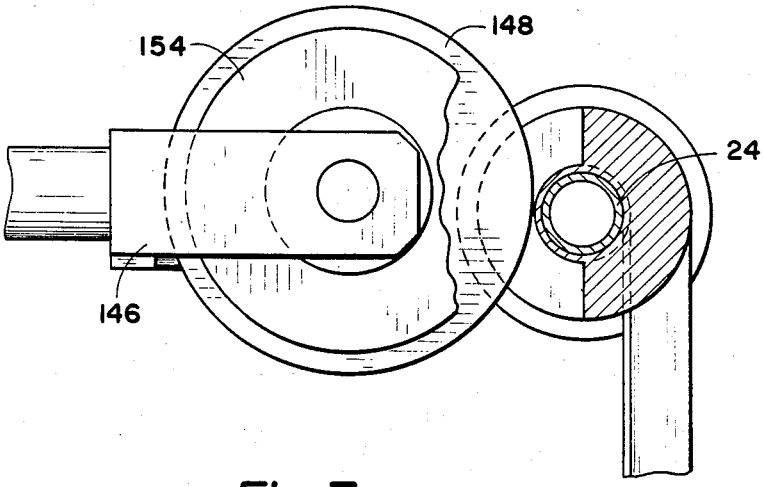
FIG. 7 is an end elevational view of the portion of the machine depicted in FIG. 6.

It is noted in the drawing at FIG. 6, the knurling wheel 148 is canted at an angle with respect to the longitudinal axis of the material 24 by an amount equal to the pitch angle of the spiral fin being added to the tube. It is further pointed out that the spacing of the knurling grooves on the wheel 148 is identical to the spacing of the knurling grooves of the knurl wheels 20 and 22 hereinbefore described.

Figure 10:
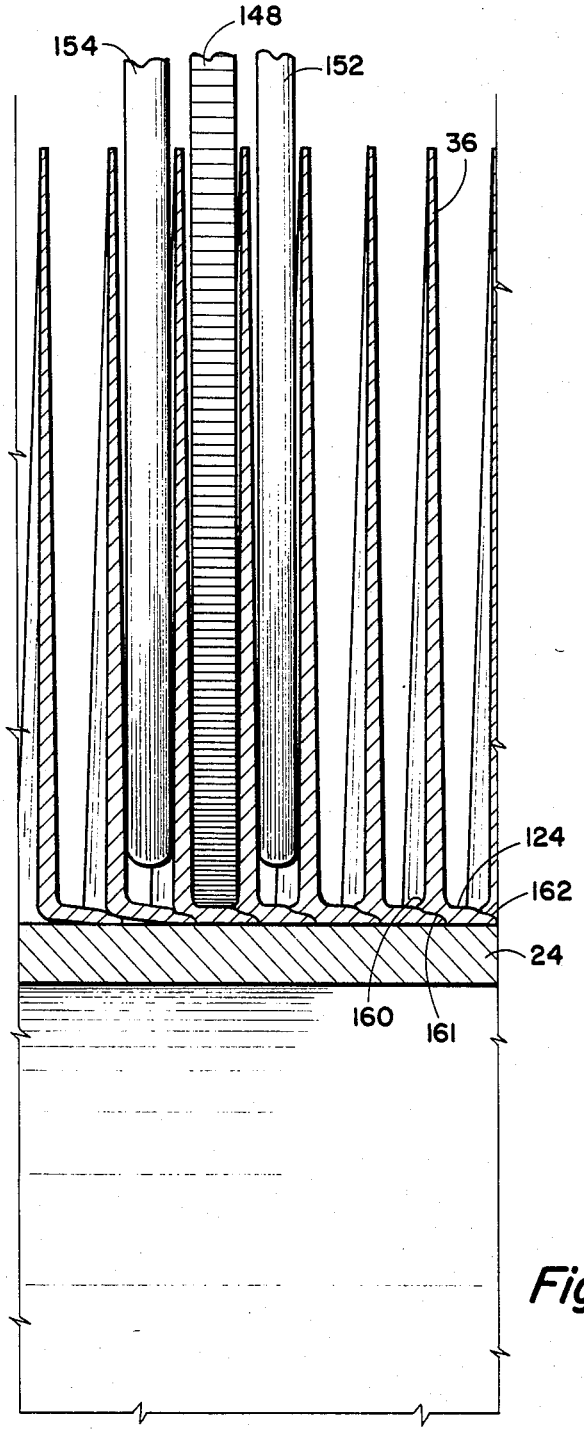
FIG. 10 is a sectional view of a heat exchanger finned tube embodying the present invention during the second knurling operation.

The width of the knurling wheel 148 is slightly wider than the distance between adjacent fin wraps at the base thereof as shown in FIG. 10 for a purpose that will be described.

In operation, bare tube material 24 is advanced and rotated by the drive knurling wheels 22. The knurling wheels 22 are pressed onto the tube by air cylinders (not shown) which drive the tube and add knurling grooves to the outer surface thereof. The two sets of knurling wheels 20 and 22 as hereinbefore described are not operated simultaneously, but sequentially whereby when the tube has reached a position which is designated for cutting, the knurling wheels 22 may be retracted while the knurling wheels 20 are then pressed into the tube thereby leaving a gap or a bare section of tubing without any knurling applied to the outer surface thereof. This is beneficial in providing bare tubing around the ends of the finished finned tube segments for effecting a seal when the finned tube is installed in tube sheets in the final heat exchanger product.

The knurled tube material 24 then is passed through the aperture 136 of the helix nut 40 where the fin stock is then applied to the outer surface of the tube.

During operation the finning head is cooled by a coolant being pumped through the head (not shown). The fin stock material 36 as hereinbefore stated, is paid off the reel 44 and passed through guide rolls 45 and subsequently through the first and second forming rollers 32 and 34. The fin stock then enters the wedge-shaped opening between the spinal roller 42 and the helix nut 40. The angle of the spinal roller 42 with respect to the helix nut 40 causes the outside surface of the finning material to be stretched in a taper more than the inside portion causing the strip to curl. By adjusting the angle of the spinal roller against the helix nut, the size of the curl is adjusted. The force between the helix nut and the spinal roller controls the amount of thinning of the fin strip. The rolling force should be adjusted so as not to thin the fin stock at the base of the fin adjacent the foot 124. It should only roll a uniform taper from the base or foot to the outside edge.

The rotational speed of the finning head components made up of the spinal roller 42 and the helix nut 40 must be adjusted with the tube surface speed. This is accomplished by adjusting the speed of the tube with a variable speed sheath (not shown).

The fin stock 36, after passing between the spinal roller 42 and the helix nut 40, is then snugly wrapped around the outer surface of the knurled tube 24. It is noted that the forward end of the fin stock 36 may be attached to the next succeeding wrap by a staple gun or other clamping means in order to start the process. The pilot guide member 52 and associated mandrel 54 is then secured to the end of the tube 24 for guiding the finned tube down the elongated track member 50. After the fin has made one or two wraps around the tube 24, the guide finger 140 is placed over the fin in order to position the fin at approximately a right angle with respect to the surface of the tube 24.

After the fin has made several wraps, the knurling wheel 148 is placed into pressing contact with the upper surface of the foot portion 124 of the fin. Pressure is then applied to the knurling wheel 148 which serves to knurl the upper surface of the foot portion 124 and to depress and deform the foot portion to fit snugly within the longitudinal grooves or knurls 26 already formed in the tube member 24. This is shown in more detail in FIG. 11 of the drawings.

Referring to FIG. 10 of the drawings it is noted that the spacing of the fin members is such that a heel portion 160 of the foot portion 124 is positioned in overlapping engagement with a toe portion 162 of the next succeeding fin. This, coupled with the width of the knurling wheel 148 causes the heel portion 160 to protrude when the knurling wheel is placed into pressing contact with the upper surface of the foot portion 124. The heel portion 160 tends to interlock with the toe portion 162 of the next succeeding fin, the pressure causing the formation of a step-like shape 161 in the heel portion 160 of each fin wrap. In this manner, the fin is not only placed into intimate contact with the knurling already provided in the tube 24, but is also interlocked to the next succeeding fin by the overlap hereinbefore described.

After the fin has been spirally wound around the tube 24, a gap in finning may be accomplished for the purpose of sawing the finished finned tube to length.

After the end of the tube 24 has passed out of the finning machine, the end of the fin may again be secured by a suitable clamp or stapler. The fin is then shoved forward and the arm 64 of the tube pushing device 56 is pivoted to place the mandrel 66 into the tube 24. The cooperating pulleys and endless chain 58 moves the finned tube along the track 50 and track segments 78 and 80 until the end of the tube pilot guide member 52 engages the micro-switch 76. Engagement of the microswitch 76 then serves to turn off the tube pusher 56, activate the clamping arms 70 and 72 and cause the saw 68 to cut the tube as shown in FIG. 1B. After the tube has been severed, the elongated arm members 88 and 90 are elevated as shown in FIG. 8 thereby allowing a finished tube member 164 to roll back against the stop members 96 and 98. As the tube rolls past the microswitch 102, the air gun 100 is activated whereupon a nozzle end 166 comes into contact with the end of the tube 24 and a blast of air is passed through the tube 24 thereby ejecting the pilot 52 out of the opposite end thereof. The pilot 52, at this point, falls onto the conveyor chain 108 and is delivered back to the finning head station shown in FIG. 1A of the drawings.

The elongated tube handling arms 88 and 90 are then lowered back into position as shown in FIG. 9 to receive a next tube member 165 therealong. The finished tube 164 then comes into contact with the inclined surface 84 of the tube rack and rolls toward the stop member 156 where it may be subsequently removed.

Whereas the present invention has been described in particular relation to the drawings attached hereto, other and further modifications apart from those shown or suggested herein may be made within the spirit and scope of the invention.

What is claimed:

1. An apparatus for producing heat exchanger finned tubing consisting of a central tube of heat conductive material and a spirally wound fin of a somewhat malleable heat conductive mterial, comprising:

first knurling means for forming a plurality of closely spaced substantially longitudinal grooves in the outer surface of the central tube and moving said tube longitudinally and rotationally;

forming means for bending one edge of the fin material into a substantially L-shaped cross-section forming a foot portion of the fin along said one edge;

roller means for tapering the thickness of the fin from a base adjacent the foot portion thereof to a thinner outer edge thereof thereby causing said fin or curl about the central tube with the foot portion being wrapped in spiraling engagement with the grooved outer surface of the central tube; and second knurling means for depressing and deforming the foot portion of the fin into close fitting meshing engagement with the substantially longitudinal grooves in the outer surface of the central tube, the heel portion of the foot portion disposed to slightly overlap a toe portion of the foot portion of the next succeeding wrap.

2. An apparatus as set forth in claim 1 wherein said second knurling means comprises a wheel member having thickness sufficient to depress and deform the heel portion into intimate engagement with the toe portion of the next succeeding wrap.

3. An apparatus as set forth in claim 2 wherein the thickness of the wheel member is slightly greater than the distance between the adjacent wraps at the base portion of the fin for forming a slight protrusion along the heel portion opposite the toe portion which further overlaps the toe portion of the foot portion being depressed and deformed.

4. An apparatus as set forth in claims 2 or 3 wherein the substantially longitudinal grooves in the central tube comprise first knurling grooves and the wheel member comprises a second plurality of knurling grooves, said first and second knurling grooves having equal spacing for depressing and deforming said foot portion into meshing engagement with said central tube.

5. An apparatus as set forth in claim 2 wherein said wheel member is freely rotatable and including power means for transversely forcing said wheel into pressure engagement with the foot portion of said fin.

6. An apparatus as set forth in claim 2 and including a pair of spaced apart guide plates, one on each side of said wheel member and spaced therefrom for maintaining alignment of the fin members on either side of said wheel member.

* * * * *

UNITED STATES PATENT AND TRADEMARK OFFICE

CERTIFICATE OF CORRECTION

PATENT NO. : 4,514,900

DATED : May 7, 1985

INVENTOR(S) : Jacques A. V. Benard

It is certified that error appears in the above-identified patent and that said Letters Patent is hereby corrected as shown below:

In Column 10, line 1, the word "or" should read --to--. In Item [73] Assignee, the name of the Assignee should be --SPIRO-GILLS, INCORPORATED --.

Signed and Sealed this

*Fourth* Day of *February 1986*

[SEAL]

*Attest:*

DONALD J. QUIGG

*Attesting Officer*

*Commissioner of Patents and Trademarks*